US008262390B1

(12) United States Patent
Levine

(10) Patent No.: US 8,262,390 B1
(45) Date of Patent: Sep. 11, 2012

(54) VIAL FOR DELIVERY OF ITS CONTENTS WITHOUT SHARDS

(75) Inventor: Jonathan B. Levine, Purchase, NY (US)

(73) Assignee: JBL Radical Innovations, LLC DE (US)

( * ) Notice: Subject to any disclaimer, the term of this patent is extended or adjusted under 35 U.S.C. 154(b) by 478 days.

(21) Appl. No.: 12/193,307

(22) Filed: Aug. 18, 2008

(51) Int. Cl.
*A61C 17/00* (2006.01)

(52) U.S. Cl. ..... 433/89; 433/215; 401/277

(58) Field of Classification Search ..... 433/80, 433/89, 90, 215; 401/277; 215/314; 222/521
See application file for complete search history.

(56) References Cited

U.S. PATENT DOCUMENTS

| | | | | |
|---|---|---|---|---|
| 4,279,527 | A * | 7/1981 | Moe et al. | 401/277 |
| 4,748,990 | A * | 6/1988 | Brown et al. | 132/320 |
| 5,509,744 | A | 4/1996 | Frazier | |
| 5,693,313 | A * | 12/1997 | Shiraishi et al. | 424/49 |
| 5,857,796 | A * | 1/1999 | Waldmann | 401/277 |
| D413,730 | S | 9/1999 | Frazier | |
| D416,389 | S | 11/1999 | Frazier | |
| 6,254,297 | B1 | 7/2001 | Frazier | |
| 6,623,272 | B2 | 9/2003 | Clemans | |
| 6,648,904 | B2 | 11/2003 | Altshuler et al. | |
| 6,755,586 | B1 | 6/2004 | Frazier | |
| D495,843 | S | 9/2004 | Frazier | |
| D504,775 | S | 5/2005 | Frazier | |
| 6,902,397 | B2 | 6/2005 | Farrell et al. | |
| 7,004,657 | B2 | 2/2006 | Frazier | |
| 7,004,756 | B2 | 2/2006 | Andersen | |
| 7,021,848 | B1 | 4/2006 | Gruenbacher et al. | |
| 7,160,111 | B2 | 1/2007 | Baughman | |
| 7,201,577 | B2 | 4/2007 | Levine | |
| 7,229,229 | B2 * | 6/2007 | Wang | 401/280 |
| 7,597,497 | B2 | 10/2009 | Levine | |
| 2007/0020028 | A1 | 1/2007 | Levine | |
| 2007/0122769 | A1 | 5/2007 | Levine | |
| 2007/0166666 | A1 | 7/2007 | Levine | |
| 2007/0183988 | A1 | 8/2007 | Prosise et al. | |
| 2009/0152267 | A1 * | 6/2009 | May et al. | 220/23.83 |

OTHER PUBLICATIONS

Carol Lewis, "Fighting Gum Disease: How to Keep Your Teeth" US Food and Drug Administration, FDA Consumer Magazine, May-Jun. 2002 http://www.fda.gov/Fdac/features/2002/302gums.

* cited by examiner

*Primary Examiner* — Ralph Lewis
(74) *Attorney, Agent, or Firm* — H. Jay Spiegel

(57) ABSTRACT

A flexible tubular vial is plugged at one end. The plug is pulled out to open the one end and define a gap between the open end of the vial and the plug. A sleeve bounds the gap. The sleeve has a rib as does the vial (or an intermediate component) that block each other so as to limit relative movement of the plug between a retracted relative position that plugs the open end and a cleared relative position that clears the open end. By squeezing the vial, contents of the vial are urged out through interstices in the plug. The contents may be a teeth whitening composition gel that urges out through interstices in the plug to a brush-like applicator to be applied to teeth or may be a topical medicine to be applied to skin.

19 Claims, 12 Drawing Sheets

VIAL FOR DELIVERY OF ITS CONTENTS WITHOUT SHARDS

BACKGROUND OF THE INVENTION

The present invention relates to a vial suited to deliver its contents without shards.

The delivery of topical medicine to the skin to treat skin conditions or to penetrate the skin for medicinal purposes is known. Likewise, the delivery of tooth whitener gel compositions is known. U.S. Pat. No. 7,201,577, for instance, discloses a tooth whitener applicator and method. The applicator is a conventional glass ampoule having a tooth whitening solution vacuum-sealed within a chamber of the ampoule. The whitening solution is a liquid based gel containing a whitening formula.

The conventional glass ampoule is contained within a cylindrical plastic sleeve closed at one end and enclosed at its other open end by the proximal termination of a brush-type applicator. An adhesive such as glue is used to adhere the periphery of the brush to the inner surfaces of the plastic cylinder. The bristles preferably have circular cross-sections so that when they are tightly packed together and adhered to the plastic cylinder, interstices between adjacent bristles are sufficiently large enough to permit flow through of the tooth whitening composition while being sufficiently small enough to prevent shards of glass from the ampoule, when popped or broken open, to pass through the brush. A cardboard sleeve surrounds the plastic cylinder to protect the user from the glass ampoule when broken.

The dimension of such interstices, therefore, imposes limitations on the tooth whitening composition. The presence of shards of glass affects the choice for design of the applicator, because it is necessary to prevent the shards from reaching the brush-type applicator for safety reasons. The solution proposed by U.S. Pat. No. 7,201,577 is to limit the size of the interstices. Such a solution, of course, would not be necessary if there were no shards.

Limiting the dimension of the interstices to prevent the passage of shards affects how viscous the tooth whitening composition can be. If the tooth whitening composition is too viscous, the interstices may become clogged due to the small size of the interstices to prevent the passage of shards through them. On the other hand, the more viscous the whitening composition, the better the whitening composition adheres to teeth, which is a desirable attribute for teeth whitening.

It would be desirable to eliminate the need to break a glass ampoule for delivering a tooth whitening composition gel. Indeed, it is desirable to prevent the creation of shards and thus (1) eliminate the need to take safety precautions to prevent the passage of the shards through interstices, (2) eliminate the need for a protective cardboard sleeve to protect the user from the shards, and (3) eliminate the risk of clogging of the gel at the interstices as might otherwise arise if the interstices size is too small and the viscosity of the gel is too high. By increasing the size of the interstices beyond that necessary to prevent the passage of shards, the viscosity of the gel may be likewise increased to enhance adhesion without creating the risk of clogging at the interstices.

SUMMARY OF THE INVENTION

One aspect of the invention resides in a flexible plastic vial. One end of the vial is preferably closed and the other preferably plugged. The plugged end opens as a plug is pulled out. This allows the contents of the vial to be squeezed and poured out through interstices to reach a brush-like applicator.

The vial is flexible to narrow an interior volume under manual squeezing pressure. There is a mating structure that closes the open end of the flexible tubular vial in a retracted relative position and that opens the open end of the flexible tubular vial in a cleared relative position to form a gap. There is a sleeve that bounds the gap. There is a blocking structure that limits relative movement of the mating structure to only between the retracted and cleared positions. There is an interstices structure that includes interstices dimensioned and arranged to permit contents of the flexible tubular vial to pass through the interstices as the flexible tubular vial is flexing under the manual squeezing pressure to reduce an interior volume of the vial and provided the mating structure is in the cleared relative position.

The squeezing of the flexible plastic vial is at a location between the ends of the vial. Such squeezing narrows the interior accordingly, which tends to urge the tooth whitening composition gel toward the path of least resistance—toward the open end. Further, by pointing the open end downward, gravity will assist in urging the tooth whitening composition gel toward the open end. A brush-type applicator receives the tooth whitening composition gel emerging through the interstices.

The contents of the flexible tubular vial may be a tooth whitening composition gel of any desired viscosity, including those of relatively high viscosities so as to better adhere to teeth surfaces to be whitened than would otherwise be the case for tooth whitening compositions of lesser viscosity. For applications other than dentistry in which the contents are delivered to a surface of a tooth, the contents may be delivered to other areas of the body. For instance, a pharmaceutical application would deliver a topical medicine or emollient to a skin surface for treatment of a medical malady, such as skin diseases, burns and other applications such as those requiring the pharmaceutical to penetrate through pores in the skin. In other applications, the contents could be an alternative medicine remedy, herbal extract or other medicinal remedy, or be used to color the skin and/or for cosmetic purposes.

BRIEF DESCRIPTION OF THE DRAWING

For a better understanding of the present invention, reference is made to the following description and accompanying drawings, while the scope of the invention is set forth in the appended claims:

FIG. 8 is an isometric view of the applicator of FIGS. 7A and 7B held by the plug of FIG. 6 that is assembled onto the vial of FIG. 5D.

DESCRIPTION OF THE PREFERRED EMBODIMENT

Figure 1A:
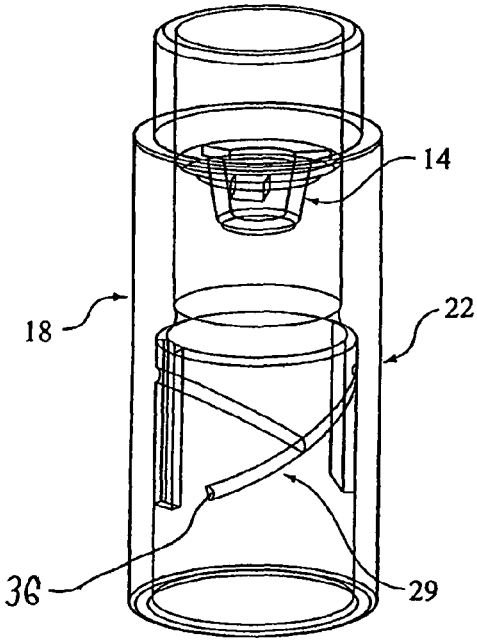
FIGS. 1A-1C are different isometric views of a plug in accordance with a two-piece twist embodiment of the invention.

Turning to the drawing, FIGS. 1A-1B, 2A-2B, 3, 4A-4C, 5, 5A-5C, 6, 6A-6B, 7A-C show a two-piece twist embodiment of a tooth whitening composition gel delivery system that does not create shards. FIGS. 8A-8D show a three-piece pull-apart embodiment of the tooth whitening composition gel delivery system that does not create shards. Both embodiments are in accordance with the invention.

Figure 1B:
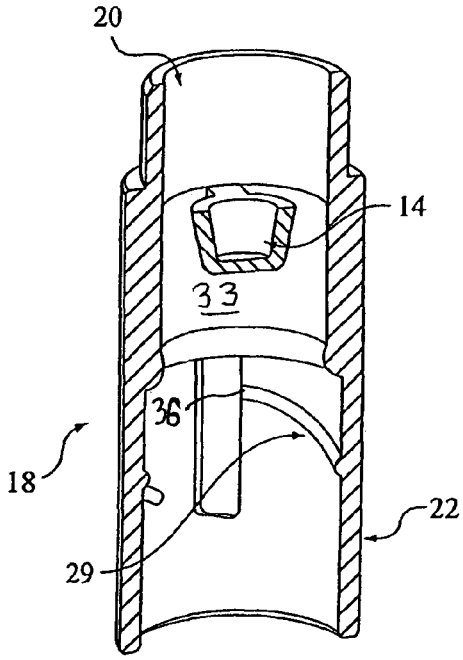
Figure 1C:
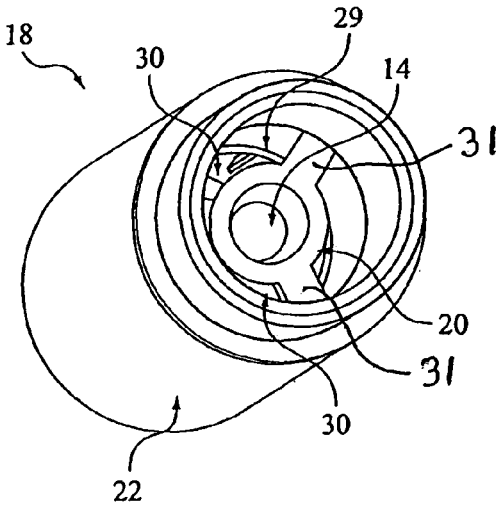
Figure 2A:
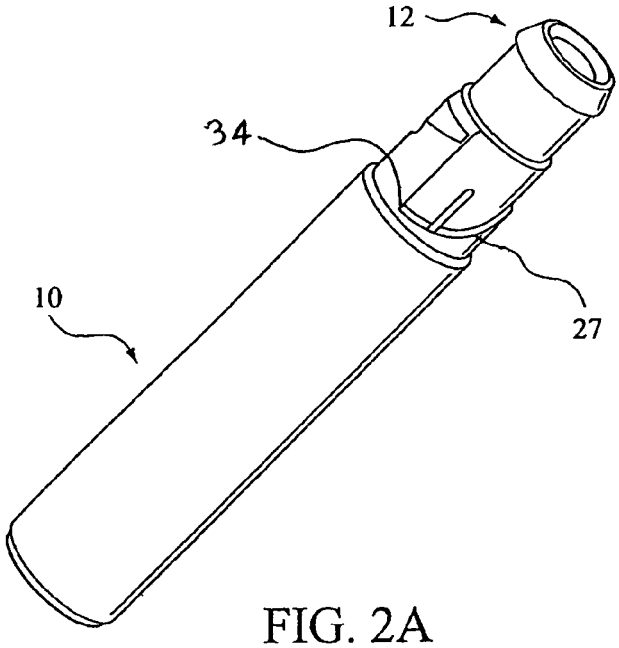
FIGS. 2A-2B are an isometric view and an elevation view, respectively of a vial in accordance with the two-piece twist embodiment of the invention.
Figure 2B:
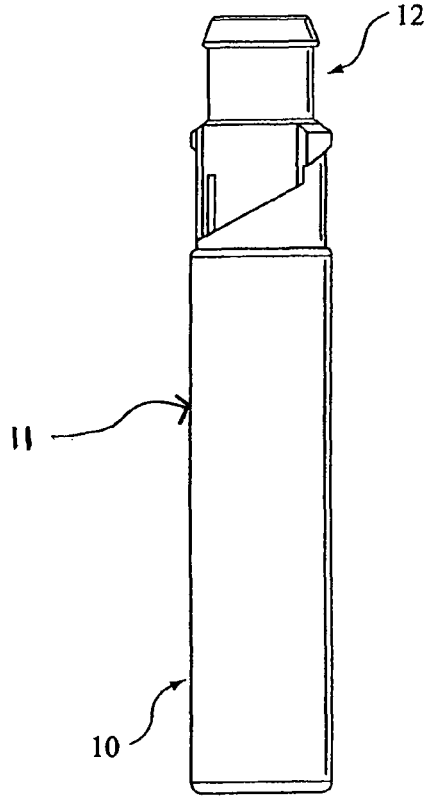
Figure 3:
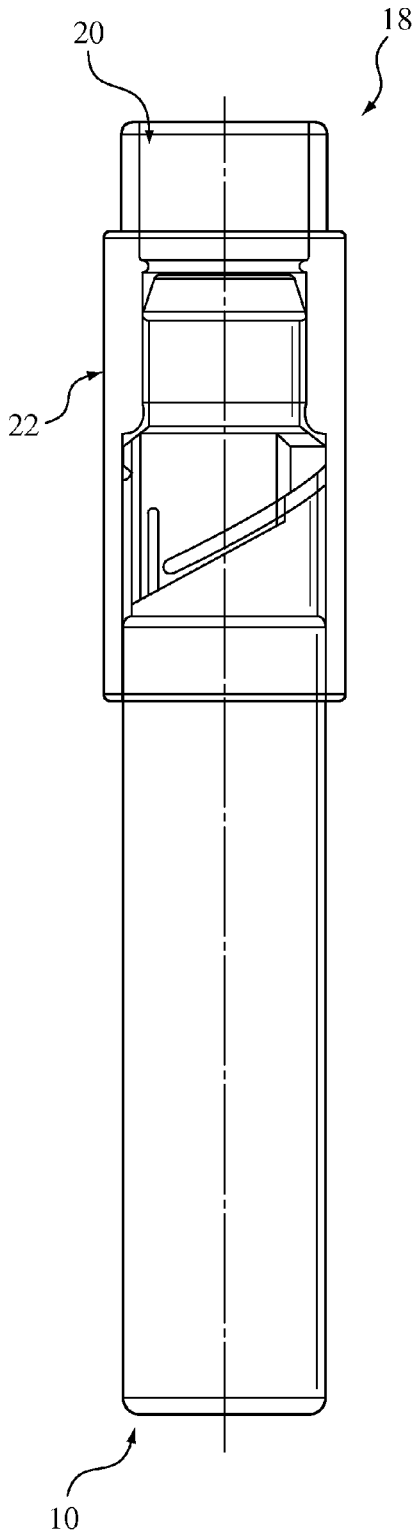
FIG. 3 is an elevation view of the two-piece twist embodiment that includes the plug of FIGS. 1A-1C plugging an end of the vial of FIGS. 2A-2B.
Figure 4A:
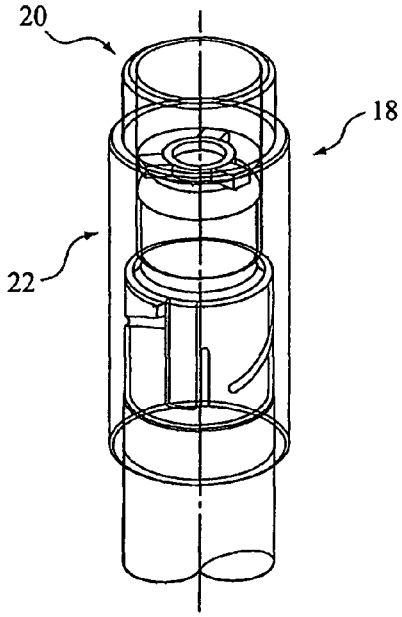
FIGS. 4A-4C are different isometric views of the two-piece twist embodiment of FIG. 3.
Figure 4C:
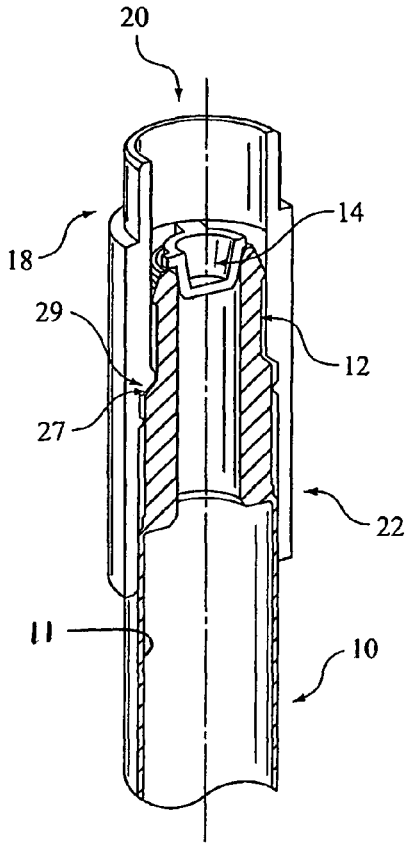
Figure 4B:
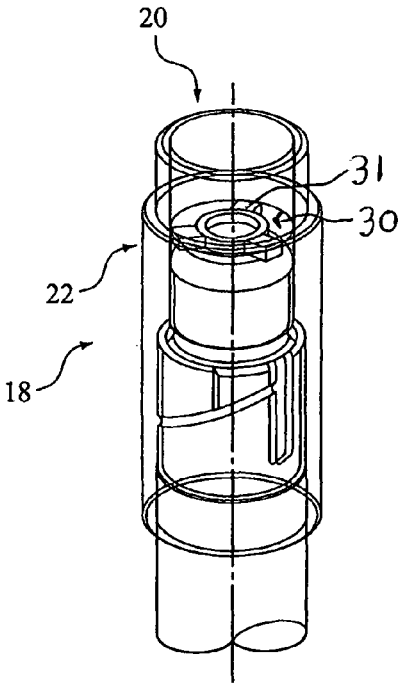
Figure 5:
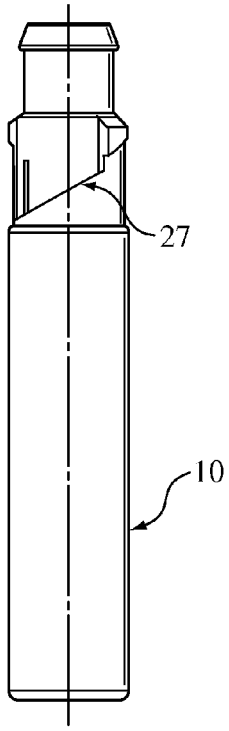
FIG. 5 is a front elevation view of the vial in accordance with the two-piece twist embodiment of the invention, which is symmetric to the rear elevation view thereof.
Figure 5A:
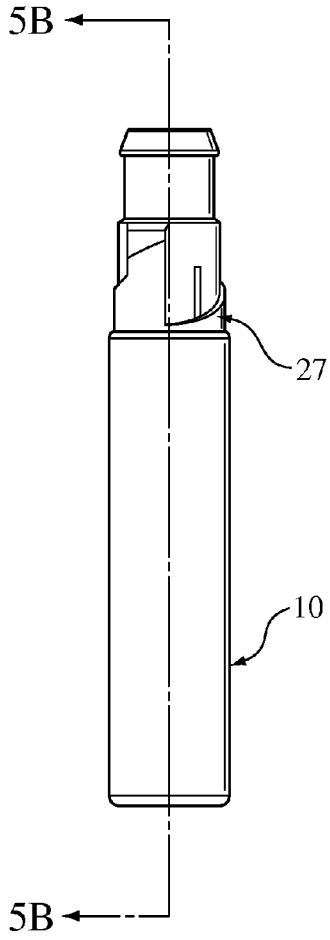
FIG. 5A is a right side elevation view of the vial of FIG. 5, which is symmetric to a left side elevation view thereof.
Figure 5B:
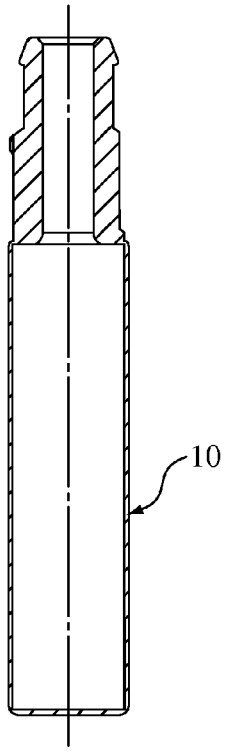
FIG. 5B is a cross-section across 5B-5B of FIG. 5A.
Figure 5C:
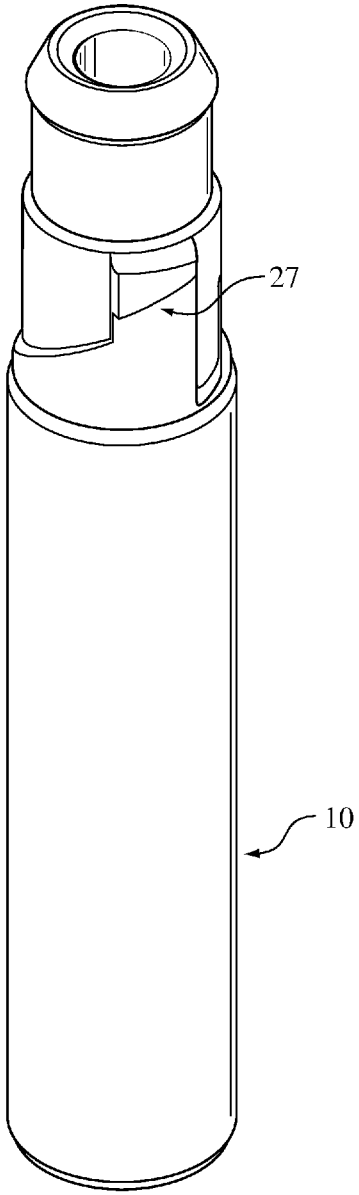
FIG. 5C is an isometric view of the vial of FIG. 5.
Figure 6:
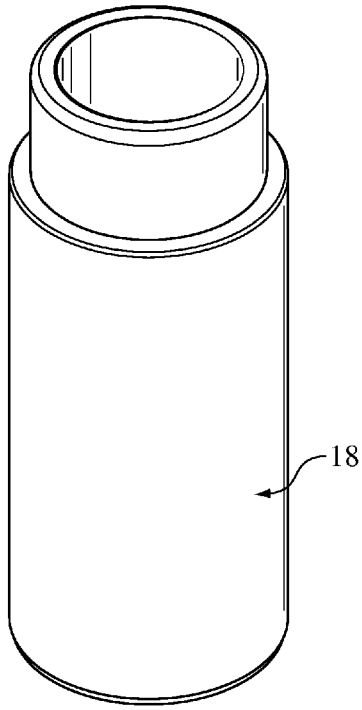
FIG. 6 is an isometric view of a plug in accordance with the two-piece twist embodiment of the invention.
Figure 6A:
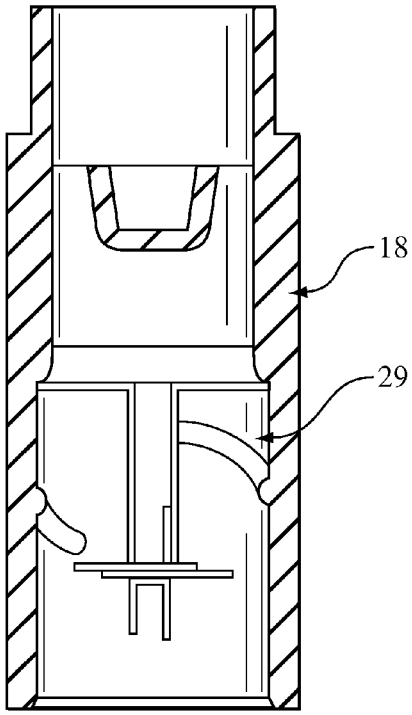
FIG. 6A is a cross-section across 6A-6A of FIG. 6B.
Figure 6B:
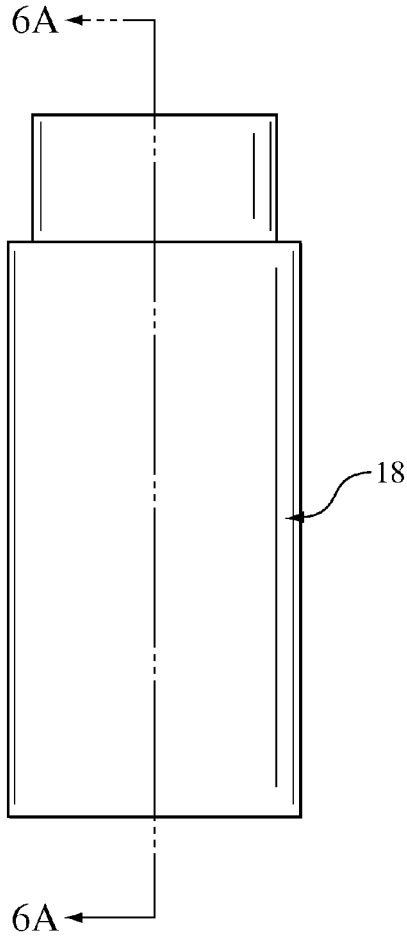
FIG. 6B is an elevation plan view of the plug of FIG. 6.

Both embodiments have a vial 10 (FIGS. 2A and 2B), a female structure 12 and a sleeve or male structure 14 (FIGS. 1A-C). In the case of the two-piece twist embodiment, the female structure 12 is integral with the vial 10. In the case of the three-piece pull-apart embodiment (FIGS. 8A-D), the female structure 12 includes an intermediate piece 16 between the male structure 14 and the vial 10. The female structure 12 and the male structure 14 may collectively be considered a mating structure since the male structure 14 is inserted into the female structure 12 to seal in a liquid-tight manner.

The present invention has application of delivery of a substance to surfaces in a variety of applications. For instance, the substance may be a tooth whitening composition delivered to a tooth for cosmetic dental applications. The substance may be a drug, such as doxycycline hyclate, delivered to an inner mouth surface such as gum surface to treat gum disease or other mouth conditions as part of a dental treatment. The substance may be a colorant delivered to a skin surface for coloring the skin for cosmetic purposes. The substance may be a topical medicine delivered to a skin surface to treat skin disorders as part of a dermatology treatment or to deliver a medicinal pharmaceutical to penetrate pores in the skin to reach target areas of the body. The substance may be an herbal extract delivered to a skin surface as part of an alternative medicine treatment.

The male structure or sleeve 18 includes a stem or a plug 14. The male structure 18 also has a cap 20 with a sleeve 22. The sleeve 22 bounds a gap 24 (FIG. 8A) formed between the male structure 18 and the female structure 12 as the cap 20 and the open end of the vial 10 are pulled apart from each other.

The male structure or sleeve 18 also includes interstices 30 arranged preferably in an equidistant manner about the inner walls 33 of the male structure 18. As seen in FIG. 1C, the interstices 30 are formed between arms 31 connecting the plug 14 to the internal walls 33 (FIG. 1B) of the male structure 18. An applicator 32 (FIGS. 7A-7C) may extend outwardly from the cap 24. Although not shown, the applicator 32 may have brushes.

Figure 7A:
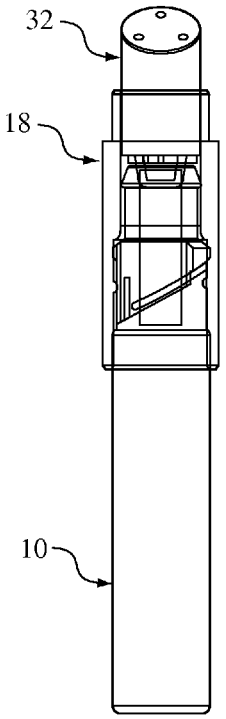
FIG. 7A is front elevation view of an applicator held by the plug of FIG. 6B that is assembled onto the vial of FIG. 5
Figure 7B:
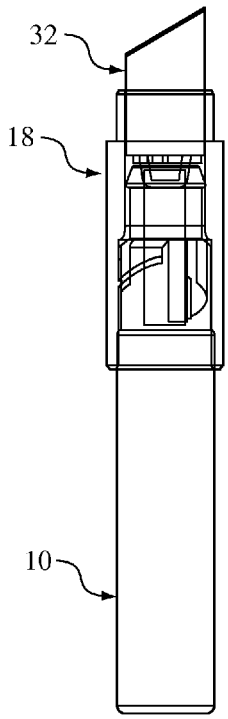
FIG. 7B is a side elevation view of the applicator of FIG. 7A held by the plug of FIG. 6B that is assembled onto the vial of FIG. 5A.
Figure 7C:
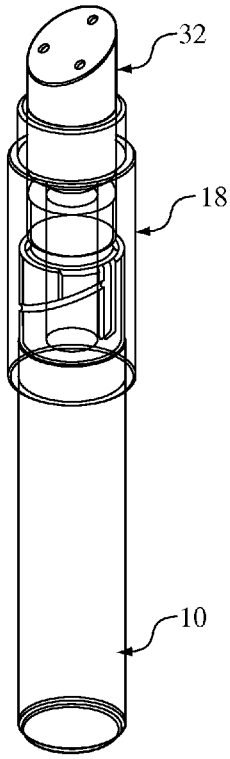
Figure 8A:
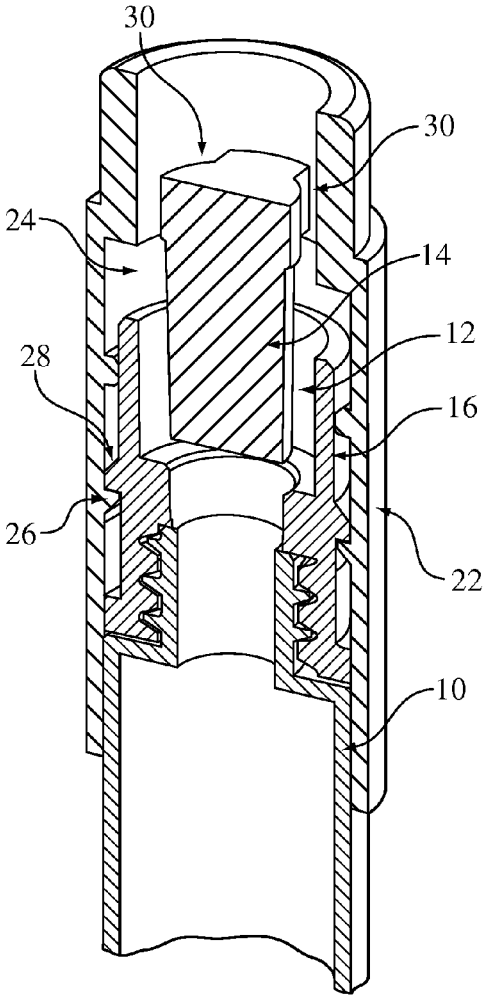
FIG. 8A is an isometric view of a three-piece pull-apart embodiment in an open position.
Figure 8B:
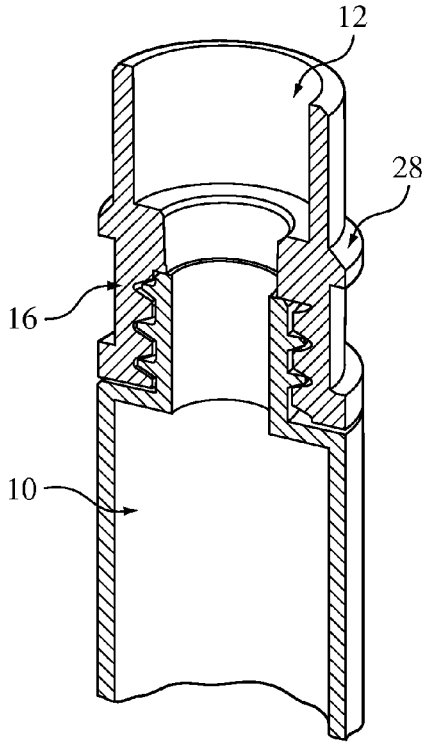
FIG. 8B is an isometric view of the three-piece pull-apart embodiment in a closed (plugged) position.
Figure 8C:
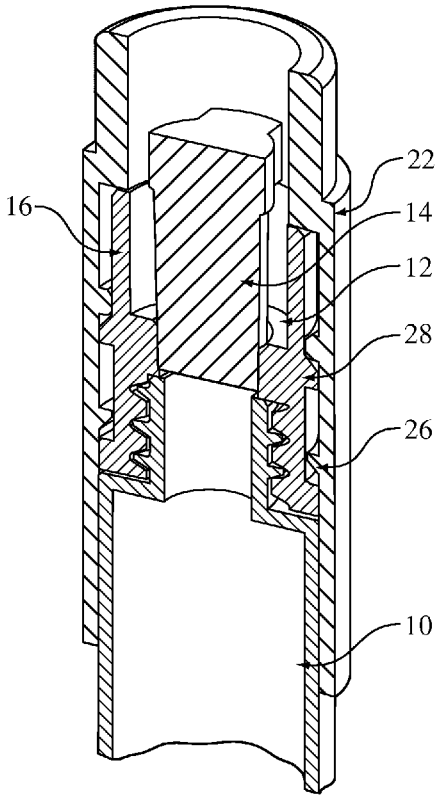
FIG. 8C is a partially broken isometric view of a female piece on an end of a vial of the three-piece pull-apart embodiment of FIGS. 8A and 8B.
Figure 8D:
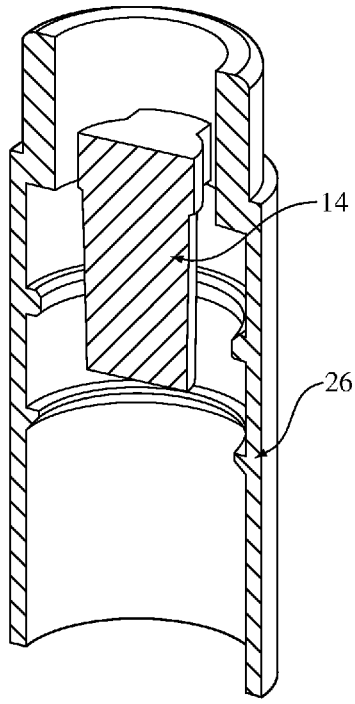
FIG. 8D is partially broken isometric view of a male piece of the three-piece pull-apart embodiment of FIGS. 8A and 8B.

The vial 10 has a proximal end with a flexible walled chamber 11 and a distal opening 13, and contains a teeth whitening composition gel of any desired viscosity. The male structure or sleeve 18 is urged to separate from the vial 10 so that the plug 14 leaves the female structure 12 to reach an unplugged or cleared position. As a result, squeezing the vial 10 causes the gel to be urged out of the vial 10 about the plug 14 and bounded by the sleeve 22 so as to reach the interstices 30 to pass through the same and reach the applicator 32 (FIGS. 7A-C). Since there is no glass vial there will be no shards and thus no need to limit the dimension of the interstices to prevent shard passage and thus gels of any viscosity may be accommodated.

The squeezing is performed at a location along the vial 10 that is spaced from ends of the vial 10. Such squeezing narrows the volume of the interior where the squeezing takes place. With less interior volume available, the gel, whose volume otherwise fills the vial 10, is urged by the manual squeezing pressure to flow along a path of least resistance. In this case, such a path leads to and through the interstices 30.

In addition, the end of the vial 10 with the male structure 18 thereon may be pointed downward so that gravity assists in urging the gel through the interstices 30. Once through the interstices 30, the gel reaches the applicator 32, which if equipped with bristles of a brush-like applicator, may be brushed on for application to the teeth. Since the vial 10 is made of flexible plastic, it flexes under pressure of squeezing and will not break. Further, since it does not contain any glass vial, no shards will be created.

Therefore, there is no need to take safety measures to prevent the passage of shards through the interstices 30 and thus the dimension of the interstices 30 need not be limited to so prevent such passage. Further, there is no need to provide for a cardboard sleeve on the vial 10 to protect the user's fingers from shards. Finally, the viscosity of the gel need not be limited so as to prevent passage of shards through the interstices 30.

Turning to the two-piece twist embodiment of FIGS. 1A-7C, the vial 10 has a screw thread 27 that spirals along an outer face of the vial 10. The male structure 18 has a screw thread 29 that spirals along an inner face of the male structure 18. The screw threads 27, 29 guide along each other to allow the male structure 18 to be screwed on or screwed off the vial depending upon whether the relative turning of the male structure 18 and the vial 10 is clockwise or counterclockwise. As such, the male structure or sleeve 18 may be moved between a first position in which the plug 14 seals the opening 13 and a second position in which the plug 14 is distal of the opening 13 to permit the contents of the vial 10 to be dispensed. Thus, the male structure 18 may be screwed off the vial 10 to allow the vial 10 to be refilled with fresh contents and then plugged with the plug to make ready for future use. During squeezing of the vial 10 to cause the contents of the vial to reach the interstices 30 in the cap 20, the female structure 12 needs to be separated from the male structure 18, but the sleeve 22 should not be screwed off completely from the vial 10 since the sleeve 22 channels the contents toward the interstices 30 during the squeezing. The male structure 18 may be made of a translucent or transparent material to allow one to visually see when the opening 13 of the female structure 12 and the plug 14 separate. Also, the extent of relative turning required to disengage the female structure 12 from the male structure 18 may be known in advance, e.g., one half turn, so that the user can be so directed to know when to squeeze the vial 10 to urge the contents of the vial 10 to reach the interstices 30. Additionally, the ends 34 (FIG. 2A), 36 (FIGS. 1A-B) of the screw threads 27, 29 may act as a limit stop limiting the degree of separation of the plug 14 from the opening in the neck of the vial 10.

Turning to the three-piece pull-apart embodiment of FIGS. 8A-8D, blocking elements or ribs 26, 28 block each other to prevent the sleeve 22 from being pulled off the vial 10 completely from the intermediate piece 16. The rib or annual land 26 projects inwardly from the sleeve 22 while the rib or annual land 28 projects outwardly from the vial 10 or intermediate piece 16 as the case may be. As seen, the land 26 on the sleeve 22 is proximal of the land 28 of the vial 10. If desired, the intermediate piece 16 could be integrally formed with the female structure 12, in which case there would be a two-piece embodiment instead of a three-piece. As the blocking elements 26, 28 block each other, such constitutes a tactile indication that the female structure 12 and the male structure 14 have separated from each other so as to allow the contents of the vial 10 to reach the interstices 30 in the cap 20 upon manual squeezing of the vial 10.

A brief discussion follows about the manner of conventional delivery of a tooth whitening composition gel by GoSMILE, Inc. with reference to FIGS. 9-15. The two-piece embodiment or the three-piece embodiment of the present invention can be substituted for such a conventional ampoule. Instead of breaking a glass ampoule inside a plastic cylinder as is done conventionally, the plug 18 of the present invention is pulled and the flexible plastic vial 10 squeezed to deliver the gel.

Figure 9:
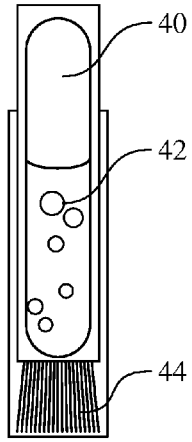
FIG. 9 (PRIOR ART)
FIGS. 9-15 are schematic diagrams in succession that depict a conventional ampoule whitening system.
Figure 10:
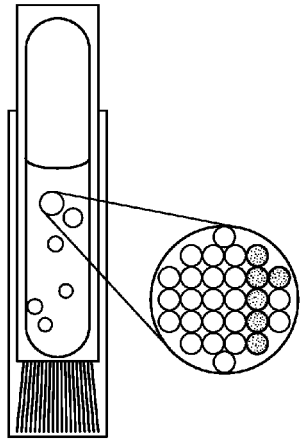
FIG. 10 (PRIOR ART)
Figure 11:
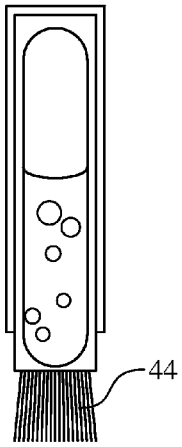
FIG. 11 (PRIOR ART)

FIG. 9 shows a conventional vacuum-sealed ampoule 40 that preserves the potency of the whitening formula 42, until it's popped and applied to teeth via a brush-like applicator top 44. FIG. 10 shows the whitening formula to be a liquid-based gel containing both an active ingredient 46 and a polymer 48 gel to help the solution stick to teeth to optimize contact time and results. FIG. 11 shows spot treatment for which the whitening formula is applied to the surface of the tooth with a soft brush 44. A user can apply extra whitening solution to areas that are prone to stains.

Figure 12:
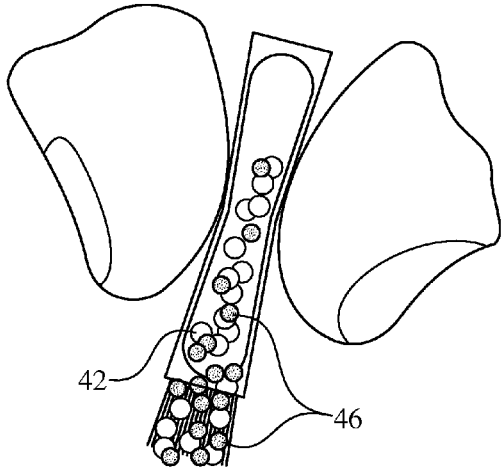
FIG. 12 (PRIOR ART)
Figure 13:
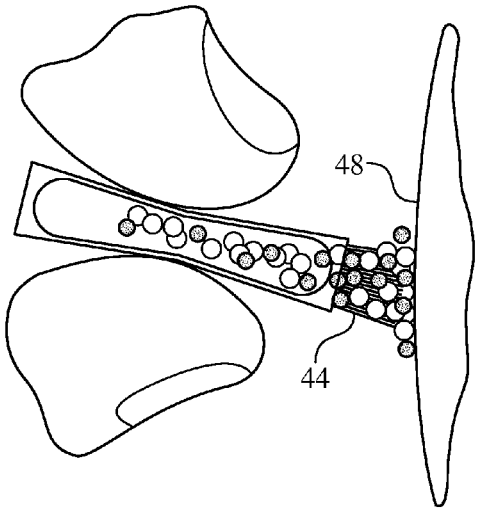
FIG. 13 (PRIOR ART)
Figure 14:
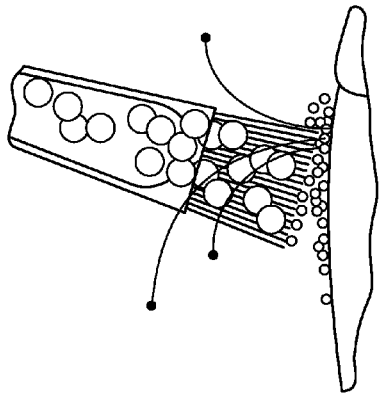
FIG. 14 (PRIOR ART)
Figure 15:
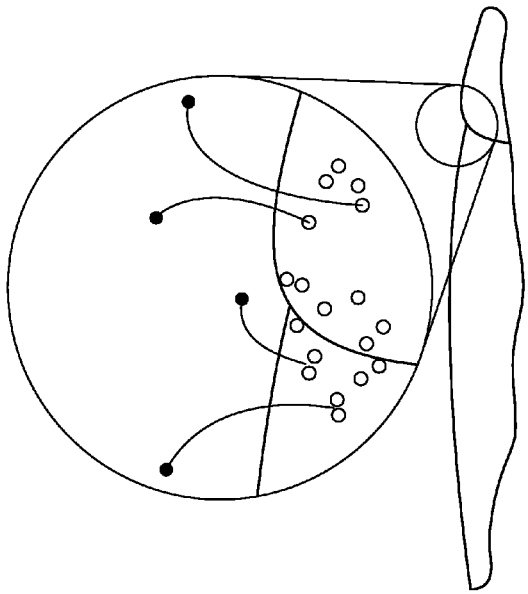
FIG. 15 (PRIOR ART)

FIG. 12 shows the squeezing out of the whitening formula from the ampoule. Once hydrogen peroxide 46 comes in contact with the air, it activates, in the form of tiny white oxygen bubbles 46. FIG. 13 shows it only takes 1-2 minutes to apply by brushing it onto the surface of teeth 48. The hydrogen peroxide polymer gel whitens the teeth for several minutes after application. FIG. 14 shows the whitening formula acts on the tooth surface with microscopic molecules of oxygen, which are released by the hydrogen peroxide solution when it exits the ampoule. This oxygen lifts the stain directly from the tooth. FIG. 15 shows that the whitening formula not only whitens teeth, but also oxygenates soft gum tissue every time it whitens. This reduces bacteria for a whiter, healthier-looking smile.

The present invention has application of delivery of a substance to surfaces in a variety of applications. For instance, the substance may be a tooth whitening composition delivered to a tooth for cosmetic dental applications. The substance may be a drug, such as doxycycline hyclate, delivered to an inner mouth surface such as gum surface to treat gum disease or other mouth conditions as part of a dental treatment. The substance may be a colorant delivered to a skin surface for coloring the skin for cosmetic purposes. The substance may be a topical medicine delivered to a skin surface to treat skin disorders as part of a dermatology treatment or to deliver a medicinal pharmaceutical to penetrate pores in the skin to reach target areas of the body. The substance may be an herbal extract delivered to a skin surface as part of an alternative medicine treatment.

While the foregoing description and drawings represent the preferred embodiments of the present invention, it will be understood that various changes and modifications may be made without departing from the scope of the present invention.

What is claimed is:

1. A dispenser, comprising:

a) a flexible vial having a proximal end and a distal end, a proximal chamber containing a quantity of a substance and having a distal opening through which said substance may be selectively dispensed;

b) a sleeve mounted over said vial and carrying a plug, said sleeve movable between a first position in which said plug seals said opening and a second position in which said plug is distal of said opening;

c) said sleeve having internal walls reciprocable over and facing external walls of said vial, said plug being attached to said internal walls by a plurality of spaced arms extending inwardly from said internal walls, with interstices created between adjacent arms to create a flow path for said substance from said opening, through said interstices and around said plug; and d) an applicator distal of said plug to facilitate applying said substance.

2. The dispenser of claim 1, wherein said substance comprises a tooth whitening composition.

3. The dispenser of claim 1, wherein said interstices are sized to permit said substance to flow therethrough regardless of viscosity.

4. The dispenser of claim 1, wherein a spacing of said second position with respect to said first position is limited by interacting structures on said vial and sleeve.

5. The dispenser of claim 4, wherein said interacting structures comprise complimentary threads on said vial and sleeve, said sleeve being rotated with respect to said vial to reciprocate said plug from said first position to said second position and vice versa.

6. The dispenser of claim 5, wherein said complimentary threads have terminations defining said second position, said terminations engaging in said second position to preclude further reciprocation of said plug distal of said second position.

7. The dispenser of claim 4, wherein said interacting structures comprise an inwardly extending annular land on said sleeve and an outwardly extending land on said vial.

8. The dispenser of claim 7, wherein said land on said sleeve is proximal of said land on said vial.

9. The dispenser of claim 8, wherein said vial includes a first piece including said chamber and a second piece including said outwardly extending land.

10. The dispenser of claim 9, wherein said first and second pieces are assembled together with complimentary threads.

11. The dispenser of claim 9, wherein said first and second pieces combine to create said distal opening.

12. The dispenser of claim 7, wherein said vial comprises a two-piece structure.

13. The dispenser of claim 6, wherein said vial comprises a one-piece structure.

14. A dispenser, comprising:

a) a flexible vial having a proximal end and a distal end, a proximal chamber containing a quantity of a substance and having a distal opening through which said substance may be selectively dispensed;

b) a sleeve mounted over said vial and carrying a plug, said sleeve movable between a first position in which said plug seals said opening and a second position in which said plug is distal of said opening, a spacing of said second position with respect to said first position being limited by interacting structures on said vial and sleeve;

c) said sleeve having internal walls reciprocable over and facing external walls of said vial, said plug being attached to said internal walls by a plurality of spaced arms extending inwardly from said internal walls, with interstices created between adjacent arms to create a flow path for said substance from said opening, through said interstices and around said plug.

15. The dispenser of claim 14, wherein said substance comprises a tooth whitening composition.

16. The dispenser of claim 15, wherein said interstices are sized to permit said substance to flow therethrough regardless of viscosity.

17. The dispenser of claim 14, wherein said interacting structures comprise complimentary threads on said vial and sleeve, said sleeve being rotated with respect to said vial to reciprocate said plug from said first position to said second position and vice versa, said complimentary threads having terminations defining said second position, said terminations engaging in said second position to preclude further reciprocation of said plug distal of said second position.

18. The dispenser of claim 14, wherein said interacting structures comprise an inwardly extending annular land on said sleeve and an outwardly extending land on said vial, said land on said sleeve being proximal of said land on said vial.

19. The dispenser of claim 18, wherein said vial comprises a two-piece structure including a first piece including said chamber and a second piece including said outwardly extending land, said first and second pieces being assembled together with complimentary threads, said first and second pieces combining to create said distal opening.

* * * * *